United States Patent [19]

McCartney et al.

[11] Patent Number: 4,501,204

[45] Date of Patent: Feb. 26, 1985

[54] OVERFIRE AIR ADMISSION WITH VARYING MOMENTUM AIR STREAMS

[75] Inventors: Michael S. McCartney, Bloomfield; William H. Pollock, East Granby, both of Conn.

[73] Assignee: Combustion Engineering, Inc., Windsor, Conn.

[21] Appl. No.: 612,114

[22] Filed: May 21, 1984

[51] Int. Cl.[3] ..... F23D 1/02

[52] U.S. Cl. ..... 110/264; 110/232; 110/302; 110/347

[58] Field of Search ..... 110/264, 265, 232, 347, 110/302; 431/173

[56] References Cited

U.S. PATENT DOCUMENTS 3,224,419 12/1965 Lowenstein et al. ..... 110/264 X 3,261,333 7/1966 Jonakin ..... 110/264 X 4,442,783 4/1984 Pajomas et al. ..... 110/232 X

*Primary Examiner*—Edward G. Favors

*Attorney, Agent, or Firm*—Robert L. Olson

[57] ABSTRACT

A tangentially-fired, pulverized coal burning furnace (10) having overfire air (OFA) introduced into the upper portion of the furnace. The fuel and air are introduced (36, 38) into the furnace at the burner level tangentially of an imaginary circle, so that the resultant fireball moves upwardly within the furnace with a rotational spin. The OFA is introduced (40, 42) tangentially of an imaginary circle, in the reverse rotational direction to that of the fireball, so that the exhaust gases flowing from the furnace to the rear gas pass (16) flows in a straight line, with little or no spin. The OFA is made up of a mixture of low pressure air and high pressure air of sufficient volume and pressure to nullify the spin of the fireball.

2 Claims, 4 Drawing Figures

OVERFIRE AIR ADMISSION WITH VARYING MOMENTUM AIR STREAMS

BACKGROUND OF THE INVENTION

To burn a given quantity of fuel, a given amount of air is theoretically required. This perfect match is called stoichiometric combustion. In practice, however, excess air is required in order to burn all of the combustibles within a limited space, such as the confines of the furnace of a steam generator. The use of excess air presents some problems, particularly in coal-fired furnaces where the fuel is introduced tangentially of an imaginary circle within the furnace. The excess air makes oxygen available for the formation of $NO_x$, which is undesirable. $NO_x$ forms most readily at high temperatures, and thus if the excess air is introduced as overfire air (OFA), above the burner level within the furnace, the formation of $NO_x$ is minimized. In tangential firing there is a large number of flow patterns which, because of the rotating "fireball", deposit solids onto the furnace sidewalls. In addition, a temperature imbalance in the exhaust gases leaving the furnace can exist, because of the spinning flow effect caused by the tangential firing of the fuel.

Patent application No. 474,114 entitled "System For Injecting Overfire Air Into A Tangentially-Fired Furnace" and filed on Mar. 10, 1983 addressed some of the above problems. That application suggests introducing OFA into a tangentially fired furnace, with the OFA being introduced with a swirling direction opposite to that of the fuel, so that the "spin" is cancelled out, thus resulting in straight or "plug" flow of the gases leaving the furnace.

SUMMARY OF THE INVENTION

The present invention is directed to an OFA arrangement in a tangentially-fired furnace burning coal, where the OFA is introduced tangentially of an imaginary circle in opposition to the swirl of the burning fuel or fireball in order to straighten out the gas flow leaving the furnace. A combination of available low pressure and high pressure air is introduced as the OFA, so that no additional fans are required to supply air of adequate quantity and pressure to overcome the spin of the fireball.

DESCRIPTION OF THE PREFERRED EMBODIMENT

Figure 1:
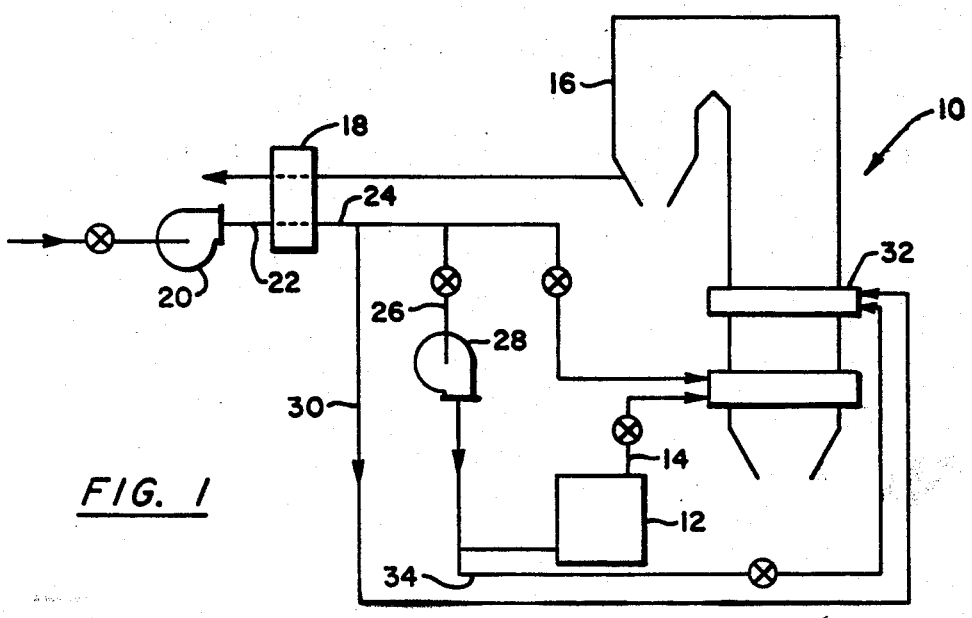
FIG. 1 is a schematic view of a steam generator incorporating an overfire air arrangement in accordance with the invention.

Looking now to FIG. 1, numeral 10 designates the furnace of a steam generator. Pulverized coal is supplied to the furnace from a pulverizer mill 12. The coal is carried to the furnace through duct 14 in a stream of high pressure air. The combustion gases, after giving up a substantial portion of its heat to generate and superheat steam, leaves the furnace 10, and after passing over more heat exchange surface in the rear pass 16, is exhausted to the atmosphere. Before it is discharged, however, it passes through air preheater 18, where air supplied by fan 20 through duct 22 is heated. The majority of this low pressure air, usually on the order of 5 inch water gauge pressure, passes through duct 24 to the furnace 10. A portion of the air in duct 24 passes through duct 26, containing a high pressure fan 28. This air stream passes through the pulverizing mill 12, where it picks up and entrains the coal particles and carries them onto the furnace. Fan 28 increases the pressure of the air in duct 26 substantially, to approximately 35 inches water gauge pressure. Some of the low pressure air from duct 24 passes through duct 30 and is introduced into the furnace at point 32, as overfire air. Also, some of the high pressure air from duct 26 passes through duct 34, and is introduced at elevation 32 as OFA also.

Figure 2:
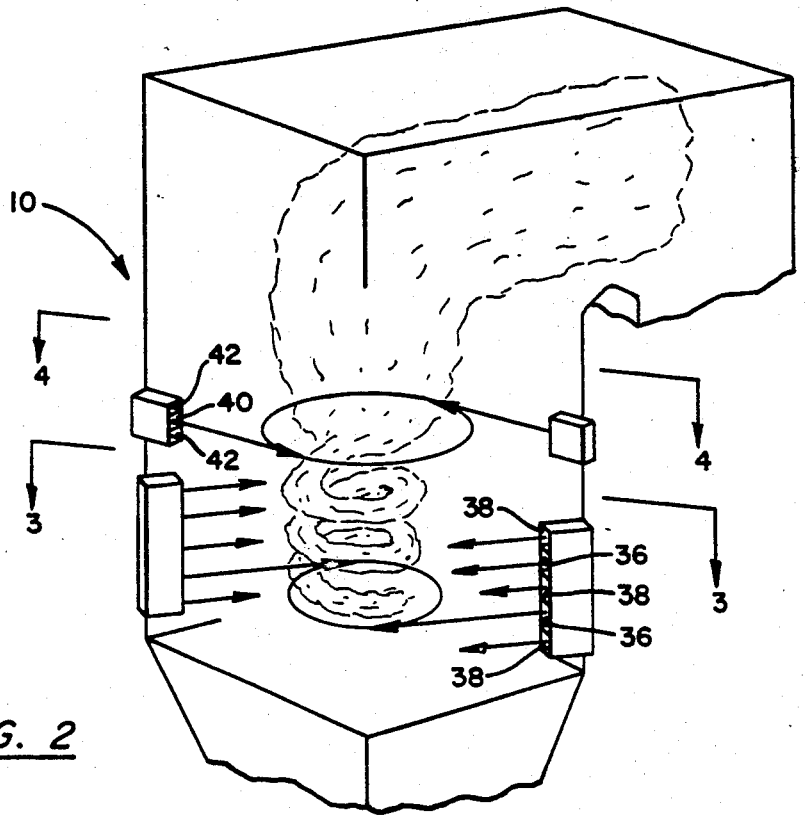
FIG. 2 is a perspective view of the furnace of FIG. 1.
Figure 3:
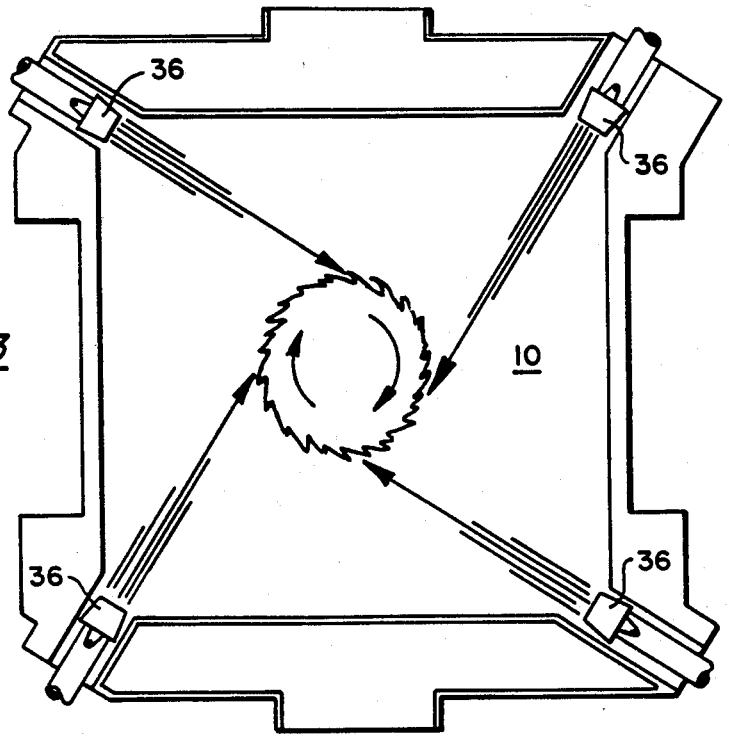
FIG. 3 is a view taken on lines 3—3 of FIG. 2.
Figure 4:
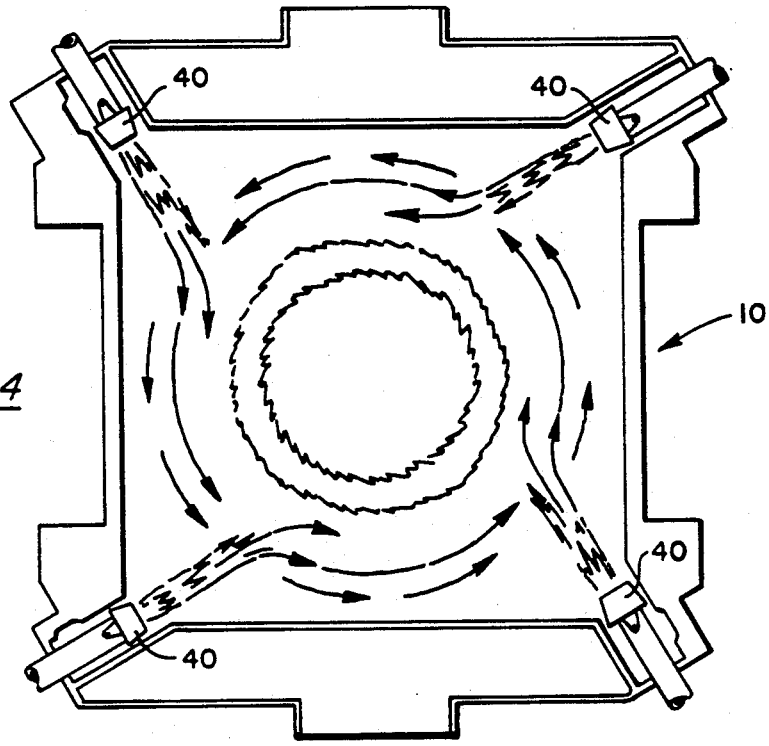
FIG. 4 is a view taken on lines 4—4 of FIG. 2.

Looking now to FIGS. 2–4, the details of the fuel and air introduction into the furnace 10 are shown in more detail. As can be seen in FIGS. 2 and 3, the coal entrained in the high pressure air stream is introduced into the furnace 10 through a plurality of ports or nozzles 36, located in each of the four corners of the furnace. These nozzles direct the fuel toward the tangent of an imaginary circle in the center of the furnace, so that the fireball created swirls upwardly in the furnace in a clockwise rotational flow, as best seen in FIG. 3. The low pressure air is introduced to the furnace at the burner level through a plurality of ports or nozzles 38, located in each of the four corners. Again, these nozzles direct the low pressure air tangentially, with the same spin as that of the fireball created by the burning fuel. These nozzles, along with the nozzles 36, are tiltable, both vertically and horizontally, so that the location of the established fireball can be varied as desired, for load control purposes.

Looking now FIGS. 2 and 4, the manner in which the overfire air is introduced can best be seen. The high pressure air is introduced through a plurality of ports or nozzles 40 located in each of the four corners of the furnace at an elevation 32 somewhat above the burner elevation. The low pressure air is introduced through a plurality of ports or nozzles 42 located in each of the four corners. Again, nozzles 40 and 42 direct the air streams tangentially of an imaginary circle in the furnace, but in a direction of spin opposite to that of the rising fireball, or counterclockwise as shown in FIGS. 2 and 4. Like the nozzles at the burner elevation, nozzles 40, 42 can be tiltable both vertically and horizontally, for control purposes. The overfire air introduced through ports 40, 42 is of such volume and pressure that it nullifies the spin of the fireball, and thus the combustion gases flow in a substantially straight path as it leaves the furnace 10 and enters the rear pass 16. This removes the temperature imbalance across the cross-section of the rear pass, which can cause some temperature imbalance problems, for example in heat exchanger 18, and also heat exchange surface in the rear pass (not shown).

In a typical unit, enough air is supplied to the burner elevation for stoichiometric purposes only. No excess air is introduced at this elevation, which would encourage the formation of $NO_x$ gas. Excess air, on the order of 15–20% of the total air, is introduced through nozzles 40, 42 as OFA. In boilers, one of the substantial costs, both in original or capital cost, and in operating cost, is fan capacity and fan operation power. By making use of the excess fan capacity of both the low pressure fan 20 and the high pressure fan 28,. sufficient excess air, at sufficient pressure, can be supplied as overfire air in accordance with the invention without requiring an additional fan to supply this OFA at the proper pressure. Approximately $\frac{1}{3}$ of the OFA is supplied by the high pressure fan 28, and $\frac{2}{3}$ by the low pressure fan 20. When these two streams intermix as they flow into the upper furnace area, they form an air flow of sufficient volume and pressure to nullify the spin of the rising fireball.

From the above, it can be seen that a system of air supply to a tangentially-fired, pulverized coal-burning furnace has been provided which results in the following advantages: (1) by stoichiometric firing at the burner level, $NO_x$ formation is suppressed, and wall slagging is reduced; (2) good mixing of the OFA takes place with the rising fireball because of the introduction in the reverse spin direction, resulting in good second-stage combustion of the unburned fuel at this point; (3) the introduction of the OFA in the reverse directional spin to that of the fireball reduces deposits on the walls of the furnace above the OFA elevation, and eliminates temperature unbalance of the exhaust gases leaving the furnace. All of the above are accomplished without the requirement of an additional fan to supply the OFA, by utilizing the excess capacity of the two existing fans.

We claim:

1. In combination, a vertical furnace of substantially square cross section, in which pulverized coal is burned, a rear pass connected to the upper portion of the furnace through which the combustion gases are exhausted from the furnace, a heat exchanger in which the combustion gases give up heat to combustion air passing therethrough, a first duct through which air is supplied to the heat exchanger, a first fan in the first duct for supplying low pressure air to the heat exchanger, first nozzle means located in each of the four corners of the furnace, for introducing coal into the furnace tangentially of an imaginary circle located in the center of the furnace, so that a fireball is created which flows upwardly therein along a first rotational path, a second duct for conveying low pressure air from the heat exchanger to the first nozzle means, a pulverizer mill in which coal is pulverized, a third duct having an inlet connected to the second duct, and an outlet connected to the pulverizer mill, second fan means positioned in the third duct, for supplying high pressure air to the pulverizer mill, a fourth duct for supplying pulverized coal carried in a high pressure air stream from the pulverizer mill to the first nozzle means, second nozzle means located in each of the four corners of the furnace above the level of the first nozzle means, for introducing overfire air to the furnace tangentially of an imaginary circle therein, in a direction of rotation opposite to that of the fireball, so that the gases flowing to the rear pass have little or no rotational flow, a fifth duct for conveying low pressure air from the second duct to the second nozzle means, and a sixth duct for conveying high pressure air from the third duct at a point downstream of the second fan to the second nozzle means.

2. The combination set forth in claim 1, including valve means in the duct means for controlling the flow therethrough.

* * * * *